US005477868A

United States Patent [19]

Rizzoli et al.

[11] Patent Number: 5,477,868

[45] Date of Patent: Dec. 26, 1995

[54] METHOD OF PRODUCING FILTER-TIPPED CIGARETTES

[75] Inventors: Salvatore Rizzoli, Bologna; Bruno Belvederi, S. Martino di Monte S. Pietro, both of Italy

[73] Assignee: G.D Societa' per Azioni, Bologna, Italy

[21] Appl. No.: 231,027

[22] Filed: Apr. 22, 1994

[30] Foreign Application Priority Data

Apr. 23, 1993 [IT] Italy ..... BO93A0165

[51] Int. Cl.[6] ..... A24C 5/47

[52] U.S. Cl. ..... 131/94; 131/29

[58] Field of Search ..... 131/94, 29

[56] References Cited

U.S. PATENT DOCUMENTS

| | | | |
|---|---|---|---|
| 2,952,105 | 9/1960 | Schur | 53/32 |
| 4,640,013 | 2/1987 | Cristian | 131/94 |
| 4,641,198 | 2/1987 | Hinchcliffe et al. | 131/94 |
| 4,825,883 | 5/1989 | Hinz et al. | 131/94 |
| 4,848,371 | 7/1989 | Belvederi | 131/94 |
| 5,349,968 | 9/1994 | Rizzoli et al. | 131/94 |

FOREIGN PATENT DOCUMENTS 2241866 9/1991 United Kingdom .

*Primary Examiner*—Jennifer Bahr

*Attorney, Agent, or Firm*—Marshall, O'Toole, Gerstein, Murray & Borun

[57] ABSTRACT

On a filter assembly machine, a succession of groups, each having two cigarette portions, a double filter between the two cigarette portions, and a gummed strip connected integral with, along a generating line of, and projecting forwards from the group, is fed by an input conveyor to a loading station where each group is transferred into a respective seat on a rolling device with multiple rolling channels; the groups being unloaded off the rolling device with a smaller pitch as compared with the input pitch.

14 Claims, 2 Drawing Sheets

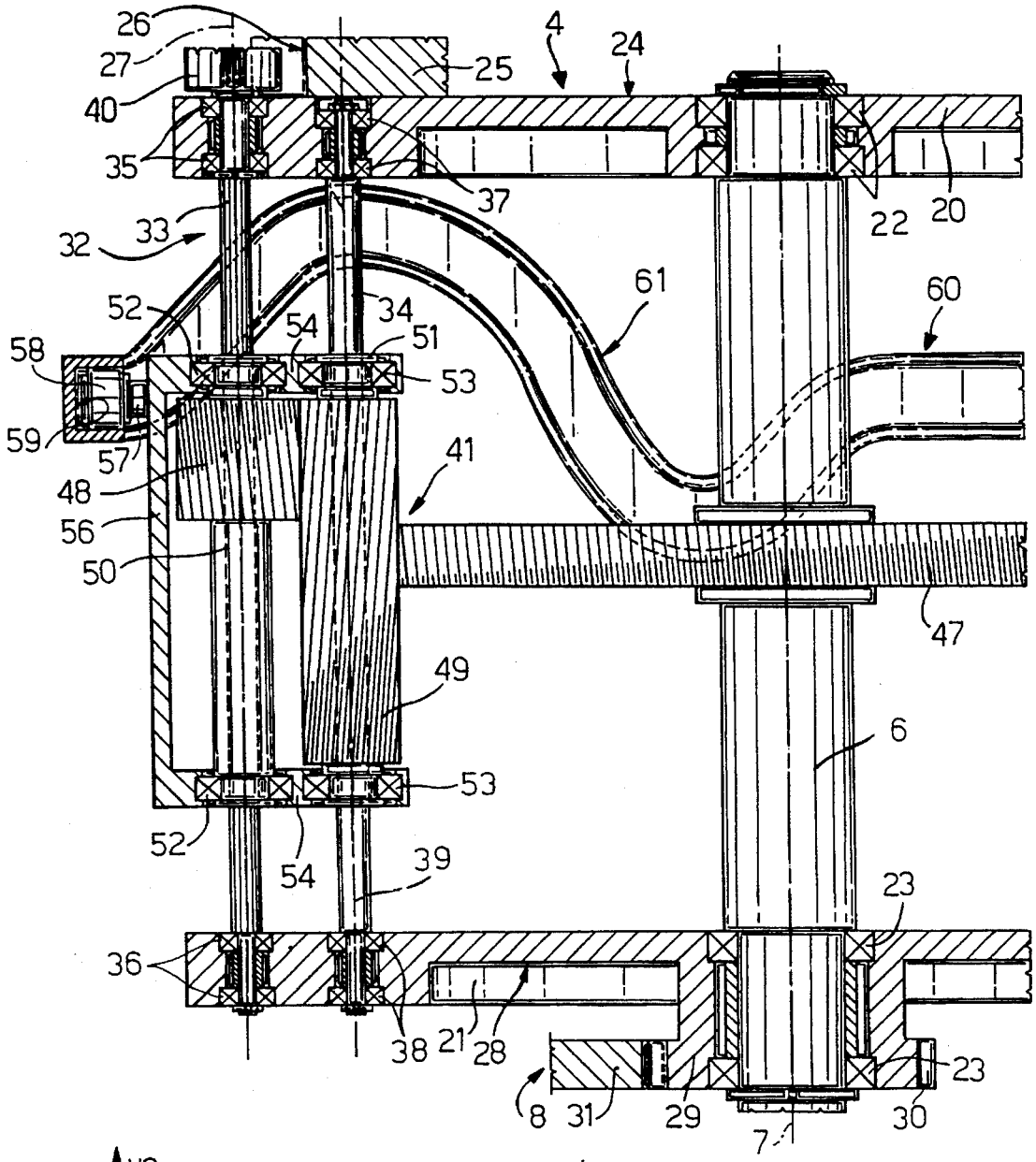
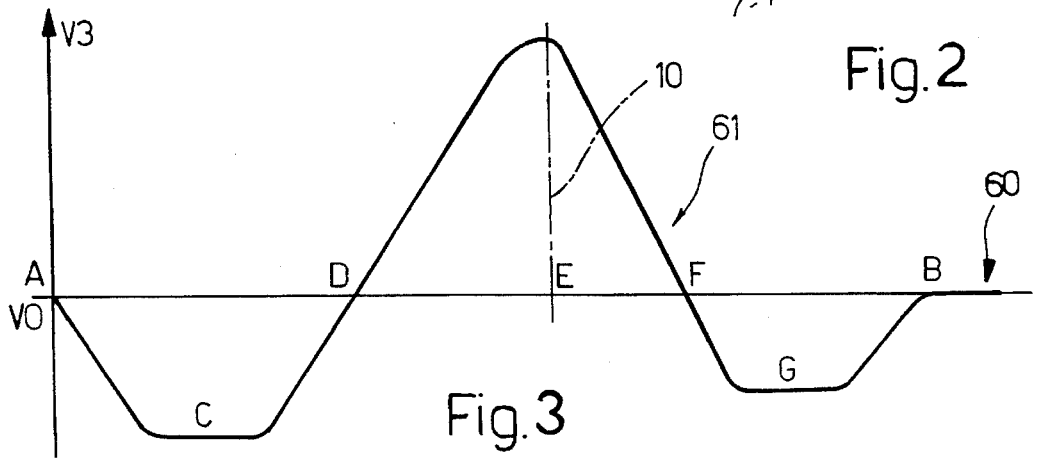
Fig.2
Fig.3

METHOD OF PRODUCING FILTER-TIPPED CIGARETTES

BACKGROUND OF THE INVENTION

The present invention relates to a method of producing filter-tipped cigarettes.

Filter-tipped cigarettes are normally produced from double cigarettes, each formed by rolling a gummed strip of paper material about a group consisting of two cigarette portions separated axially by a filter twice as long as that of a finished filter-tipped cigarette.

The strips are normally rolled about said groups by means of a rolling device to which the groups are normally fed by an input roller with a number of peripheral seats. Each seat receives and retains by suction both a respective group, and a respective gummed strip with one end connected to the group, along a generating line of the group opposite the seat, and projecting rearwards from the group in relation to the rotation direction of the input roller.

U.S. Pat. No. 4,848,371 relates to a so-called "multiple-channel" rolling method.

Here and hereinafter, the term "multiple-channel rolling" is intended to mean a rolling method whereby each group is fed to a respective transfer conveyor by which it is fed along a respective rolling channel in turn traveling along a given path.

More specifically, as described in U.S. Pat. No. 4,848,371, the input roller transfers the groups successively to a central rolling device or drum substantially tangent to the input roller at a loading station, and rotating, at a first given speed equal, at the loading station, to that of the input roller, about an axis parallel to the rotation axis of the input roller. The central drum comprises a ring of peripheral transfer rollers, each mounted on the drum so as to rotate, in relation to the drum, about a respective axis parallel to the rotation axis of the drum, and so as to define, with a peripheral portion of the drum, a respective rolling channel moving at said first speed along a circular path. Each transfer roller presents a respective peripheral seat which, by virtue of the central drum and the respective transfer roller rotating about their respective axes, travels through the loading station together with and at the same speed as a corresponding seat on the input roller, and is supplied by the input roller with a respective group and strip, which it feeds along said respective rolling channel. At the end of the rolling operation, said seat receives the newly formed double cigarette and, in the same way as for pickup but in reverse, transfers it to a seat on an output roller.

The advantages of multiple-channel as compared with standard single-channel rolling are considerable in that the multiple channels not only provide for rendering rolling speed substantially independent of the traveling speed of the cigarettes, thus enabling faster production speeds, but also prevent total stoppage of the machine in the event of a cigarette being damaged inside the rolling channel.

One drawback of multiple-channel rolling, however, poses problems in the case of applications involving production speeds over and above a given limit. In fact, as a consequence of the manner, described above, in which each group and respective strip on the input roller are presented at the loading station, the group is transferred to the seat on the respective transfer roller with the strip facing the latter seat and extending rearwards in relation to the traveling direction of the central drum.

Since the strip faces rearwards, winding of the strip about the respective group—which is performed by expelling the group from the seat on the transfer roller and rolling it on the surface of the transfer roller and on the respective strip along the respective rolling channel—can only be performed by rolling the group backwards in relation to the respective transfer roller, which in turn can only be achieved by rotating the transfer rollers in the same direction as the central drum, with the result that, at the loading station, the speed of the central drum is added to that of the seat on each transfer roller, and the pitch of the seats on the input roller is much greater than the already relatively wide pitch of the axes of the transfer rollers about the periphery of the central drum.

The relatively wide pitch of the seats on the input roller, and consequently also on the output roller, poses serious drawbacks in that, on the one hand, at high production speeds, the traveling speeds of the cigarettes up- and downstream from the rolling drum are practically unsustainable, and, on the other, a relatively drastic and hence relatively complex pitch reduction is required along the filter assembly machine, prior to feeding the cigarettes to the input conveyor of the packing machine.

SUMMARY OF THE INVENTION

It is an object of the present invention to provide a multiple-channel rolling method designed to overcome the aforementioned drawbacks.

According to the present invention, there is provided a method of producing filter-tipped cigarettes, the method being characterized by the fact that it comprises, in combination, stages consisting in feeding, by means of an input conveyor, in a given direction and with a first given pitch , a succession of groups, each comprising at least one cigarette portion, a filter, and a gummed strip connected integral with and along a generating line of the group, and projecting forwards from the group in said given direction; successively transferring said groups into respective seats on a rolling device of the type presenting multiple rolling channels, the rolling device feeding said seats with a second given pitch along a path tangent to the input conveyor at a loading station and to an output conveyor at an unloading station; rolling said groups into filter-tipped cigarettes as they travel between said loading and unloading stations; and transferring the filter-tipped cigarettes to the output conveyor by adjusting the pitch of the cigarettes so that they are fed along the output conveyor with a third pitch differing from the first pitch.

BRIEF DESCRIPTION OF THE DRAWINGS

A non-limiting embodiment of the present invention will be described by way of example with reference to the accompanying drawings, in which:

FIG. 2 shows an axial section of a detail in FIG. 1;

FIG. 3 shows an operating graph of the FIG. 2 detail.

DETAILED DESCRIPTION OF THE INVENTION

Figure 1:
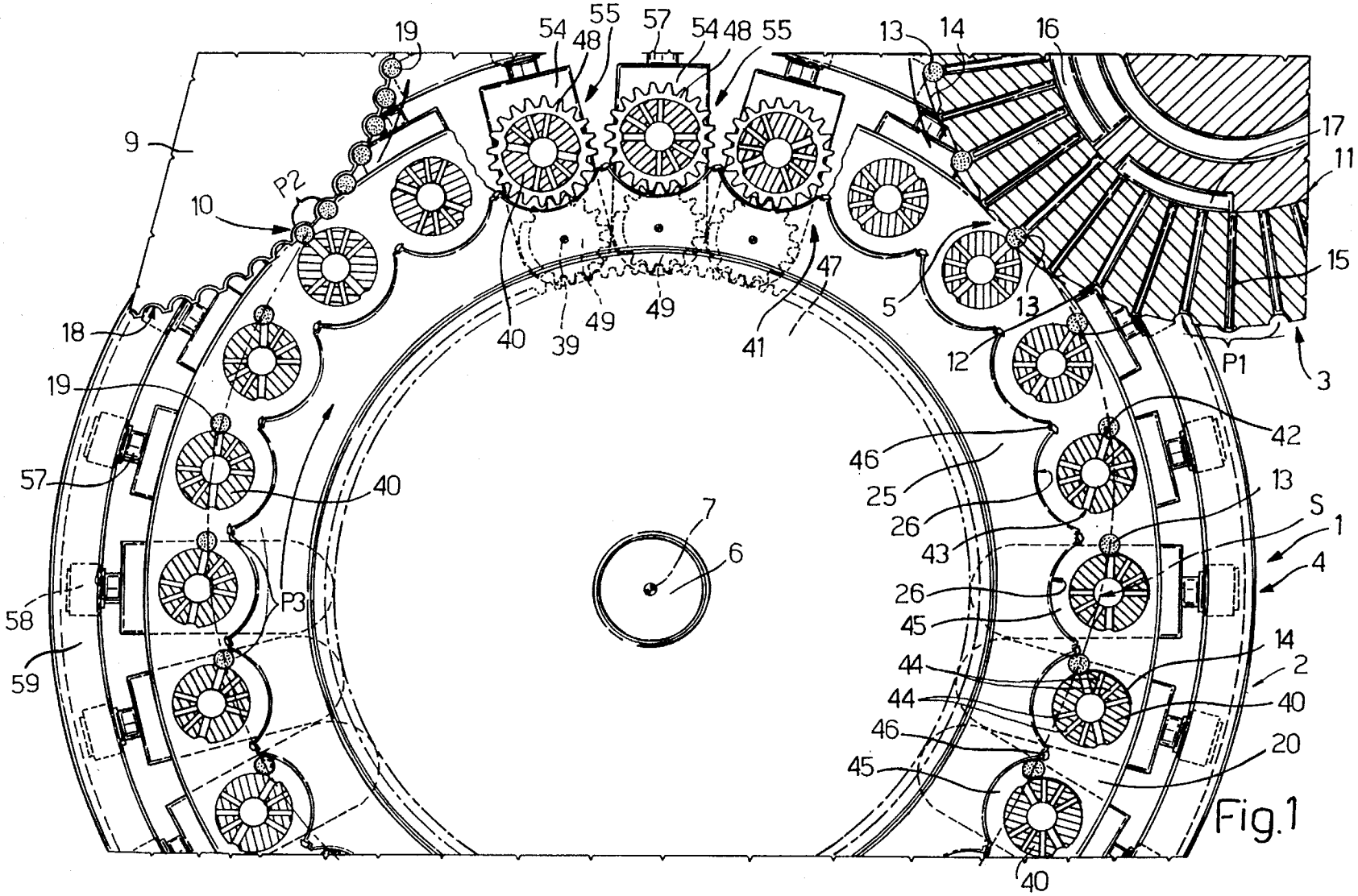
FIG. 1 shows a partial, schematic view of a portion of a filter assembly machine implementing the method according to the present invention.

Number 1 in FIG. 1 indicates a filter assembly machine comprising a powered rolling unit 2 in turn comprising an input roller 3 rotated by a known drive device (not shown) about its axis (not shown) perpendicular to the FIG. 1 plane. Unit 2 also comprises a central rolling drum 4 substantially tangent to roller 3 at a loading station 5, fitted in rotary manner to a fixed central shaft 6, and rotated by a drive device 8 about the axis 7 of shaft 6, parallel to the axis (not shown) of roller 3. Finally, unit 2 comprises an output roller 9 substantially tangent to drum 4 at an unloading station 10, and rotated by a known drive device (not shown) about its axis (not shown) parallel to axis 7.

Device 8 rotates drum 4 clockwise (in FIG. 1) about axis 7 at a substantially constant given speed, while rollers 3 and 9 are rotated anticlockwise (in FIG. 1) about their respective axes (not shown) at respective substantially constant speeds by said drive devices (not shown).

As shown in FIG. 1, roller 3 is defined by a perforated tubular body supported in rotary and axially-fixed manner on a fixed central pneumatic distributor 11, and rotated anticlockwise (in FIG. 1) in relation to distributor 11. Roller 3 presents a number of peripheral seats 12 equally spaced by distance P1, and each of which receives a respective group 13, defined (in known manner not shown) by two cigarette portions (not shown) separated by a double filter (not shown), and a respective gummed strip 14. Strip 14 provides for joining the two cigarette portions of respective group 13 to the respective double filter, and is arranged, on roller 3, with its rear portion (in the traveling direction of seats 12) gummed to a generating line of respective group 13 opposite respective seat 12, and with its front portion projecting forwards in relation to group 13 and resting on a respective retaining element 15 located on the periphery of roller 3 in front of said seat 12 in the rotation direction of roller 3.

Distributor 11 comprises a suction chamber 16 communicating with a given number of seats 12 and elements 15 immediately upstream from station 5; and a compressed air supply chamber 17 communicating with at least seat 12 and respective element 15 immediately downstream from station 5 in the rotation direction of roller 9.

Output roller 9 presents a known internal structure (not shown) similar to that of roller 3, and a number of peripheral seats 18 equally spaced by distance P2 smaller than P1, for receiving and retaining by suction respective double filter-tipped cigarettes 19 fed by drum 4 through station 10.

Drum 4 is supplied by roller 3 with a succession of groups 13 with respective strips 14, and provides for connecting said cigarette portions and said filter (not shown) in each group 13 by winding respective strip 14 about the filter and the respective ends of the cigarette portions adjacent to the filter to form a double cigarette 19.

As shown particularly in FIG. 2, drum 4 comprises a substantially circular front disk 20 and rear disk 21, fitted idly to shaft 6 and coaxially with axis 7 via the interposition of respective bearings 22 and 23. On its front surface 24, disk 20 is fitted integral with a disk 25 smaller in diameter than disk 20, and the outer lateral surface of which presents a succession of radial cavities 26, each with its concavity facing outwards, and each defined by a cylindrical surface extending about a respective axis 27 parallel to axis 7. On its rear surface 28, rear disk 21 is fitted with a sleeve 29 coaxial with axis 7, and the rear end of which presents teeth 30 constituting the output element of device 8, which also comprises a powered gear 31 meshing with teeth 30 for rotating disk 21 clockwise (in FIG. 1) about axis 7. Disk 21 is made angularly integral with disk 20 by a connecting device 32 comprising a number of pairs of rods 33 and 34 parallel to axis 7 and equal in number to cavities 26. More specifically, each rod 33 is coaxial with respective axis 27, and is supported in rotary and axially-fixed manner by disks 20 and 21 via the interposition of bearings 35 and 36; whereas corresponding rod 34 is offset radially towards axis 7 in relation to rod 33, and is supported in rotary and axially-fixed manner by disks 20 and 21 via the interposition of bearings 37 and 38 coaxial with each other and with a respective axis 39 parallel to axis 27.

Each rod 33 projects frontwards of surface 24 of disk 20, and is fitted with a respective transfer roller 40 rotated anticlockwise (in FIG. 1) about respective axis 27 by a drive 41, and presenting two diametrically-opposed peripheral suction seats 42 and 43, and a number of suction holes 44 behind each seat 42, 43 in the rotation direction of roller 40. Together with the inner surface of respective cavity 26, each roller 40 defines a curved rolling channel 45 of a width roughly equal to but no larger than the diameter of group 13, and presenting a roll-initiating tooth 46 at the input.

As shown in FIG. 2, drive 41 comprises a fixed helical sun gear 47 between disks 20 and 21 and fitted to a central portion of shaft 6; and, for each roller 40, a helical gear 48 coaxial with respective axis 27, and an idle helical gear 49 coaxial with respective axis 39 and interposed between gear 47 and respective gear 48. Gear 49 is longer than respective gear 48, and much longer than sun gear 47.

Gears 48 and 49 of each roller 40 are fitted to respective sleeves 50 and 51 in turn fitted in axially-sliding manner to respective rods 33 and 34 between disks 20 and 21, and supported for rotation, via the interposition of respective bearings 52 and 53, on the opposite arms 54—substantially radial in relation to axis 7—of a respective substantially C-shaped frame 55 comprising an intermediate core 56 parallel to axis 7 and connecting the two arms 54. A pin 57 projects radially outwards from core 56 of each frame 55, and supports in idle manner a tappet roller 58 engaging a fixed drum type cam 59 extending about axis 7 and presenting a level portion 60, and a substantially sinusoidal portion 61 extending along an arc AB, located upstream from station 5 in the rotation direction of drum 4, and comprising station 10.

Upon tappet roller 58 of each frame 55 engaging portion 61 of cam 59, frame 55 moves axially along respective rods 33 and 34 so that respective gear 49 moves axially in relation to sun gear 47; and, due to the helical teeth of gears 49 and 47 meshing with each other, said axial displacement, depending on its direction, provides for angularly accelerating or decelerating gear 49, and for increasing or decreasing the angular speed of respective roller 40 about respective axis 27.

More specifically, as of point A of said arc AB, each roller 40 is decelerated to a minimum speed at point C, at which it is accelerated to return to its original speed at point D and to a maximum speed, greater than the original speed, at point E in station 10. As of this point, the angular speed of roller 40 is again decelerated to return to its original speed at point F, and to a further minimum speed at point G, from which it is restored to its original speed at point B.

As in the example shown, the angle by which roller 40 is backed up along arc AD, as compared with a roller 40 rotating at constant speed V3=V0, is preferably recovered along arc DE, which also applies to arcs FB and EF. By moving roller 40 as described above, therefore, it is possible for it to assume, at points A, E and B, the same angular position as a roller 40 rotating at constant speed V3=V0 along the whole of arc AB. Portion 61 of cam 59 would of course be designed differently for simply increasing speed V3 to a maximum at point E.

Gear 47 and gears 48, 49 are so sized that, as drum 4 rotates about its axis 7, each roller 40 makes a finite number (two, in the example shown) of full turns about its axis 27 as it travels between station 5 and station 10, and turns a further 180° about its axis 27 as it travels between station 10 and station 5.

By virtue of drum 4 rotating about axis 7, and rollers 40 simultaneously rotating about respective axes 27 and in relation to roller 3, each group 13 transported by drum 4 between stations 5 and 10 travels precessionally along a substantially circular path S through stations 5 and 10; and, as drum 4 rotates, seats 42, 43 engaged by groups 13 travel along path S with a variable pitch P3 always greater than pitch P1 and P2.

Operation of machine 1 will now be described, for the sake of simplicity, with reference to one group 13 retained by suction by chamber 16 inside a seat 12, having a respective forward-projecting strip 14, and traveling towards station 5 at a substantially constant speed V1; and with reference to one roller 40 fed by drum 4 towards station 5 at a speed V2 equal to speed V1 at station 5, and rotated about its axis 27 by drive 41 at a surface speed V3, so that, at station 5, V1=V2– V3.

Group 13 reaches station 5 simultaneously with a suction seat 42, 43 on roller 40, and, by cutting off suction through chamber 16, is drawn by suction into seat 42, 43 with respective strip 14 directly contacting seat 42, 43 and facing forward in the rotation direction of drum 4, but rearwards in the rotation direction of roller 40 in relation to drum 4.

A compressed air jet from chamber 17 is directed through respective element 15 on to strip 14 immediately downstream from station 5, so that strip 14 adheres to the outer surface of roller 40 on which it is retained by suction through holes 44.

On receiving group 13 and respective strip 14, roller 40 continues rotating anticlockwise so that group 13 engages rolling channel 45 and, on contacting tooth 46, is detached from seat 42, 43 and begins rolling between the surfaces of roller 40 and cavity 26 and along channel 45 at a traveling speed equal to half the surface speed of roller 40. As it does so, group 13, in the example shown, makes two full turns about its axis, and strip 14, formerly adhering only by its rear edge to group 13, is wound about group 13 to connect the cigarette portions and the filter and so form a double filter-tipped cigarette 19. On reaching the output of channel 45, group 13 engages seat 43, 42 diametrically opposite former seat 42, 43.

At this point, roller 40 continues to be rotated anticlockwise (in FIG. 1) by drive 41, and at the same time is fed by drum 4 to station 10 where the newly formed double cigarette 19 is transferred in known manner to roller 9.

Between stations 5 and 10, the speed V3 of roller 40 is maintained substantially constant as respective roller 58 travels along level portion 60 of cam 59, but is varied upon roller 58 engaging portion 61 of cam 59, and reaches a maximum speed, decidedly greater than the speed along portion 60 (more specifically, at station 5) as roller 40 travels through station 10.

Positioning strips 14 so as to extend forwards in relation to respective groups 13 on roller 3 therefore provides for rotating rollers 40 in the opposite direction to drum 4, and so drastically reducing the resulting speed of seats 42, 43 through station 5 and seats 43, 42 through station 10, as compared with the speed V2 imparted by drum 4 to axes 27. As a result, the pitch P1 and P2 of seats 12 and 18 is less than pitch P3 of groups 13 along path S, thus reducing speed V1 for a given number of groups 13 fed per unit of time through station 5.

Moreover, as speed V3 is maximum at station 10, the ratio between pitches P1 and P3 will be the inverse of that of speeds V3 at stations 5 and 10 respectively. In other words, by appropriately designing portion 61 of cam 59, the pitch between input roller 3 and output roller 9 of rolling unit 2 may be reduced as required.

We claim:

1. A method of producing filter-tipped cigarettes, the method comprising stages of feeding a succession of groups by means of an input conveyor in a given direction and with a first given pitch, each group comprising at least one cigarette portion, a filter, and a gummed strip connected integral with and, along a generating line of, the group, and projecting forwards from the group in said given direction; successively transferring said groups into respective seats each provided on a respective rolling conveyor mounted for movement on a transfer conveyor defining a rolling channel along each rolling conveyor; moving the transfer conveyor so as to feed said seats with a second given pitch along a path tangent to the input conveyor at a loading station and to an output conveyor at an unloading station; moving said rolling conveyors in relation to said transfer conveyor so as to roll said groups along the respective rolling channels into filter-tipped cigarettes as said groups travel between said loading and unloading stations; and transferring the filter-tipped cigarettes to the output conveyor by adjusting, by means of said rolling conveyors, the pitch of the cigarettes so that they are fed along the output conveyor with a third pitch differing from the first pitch.

2. A method as claimed in claim 1, wherein the third pitch is smaller than the first.

3. A method as claimed in claim 1, including a further stage of retaining by suction the front portion of each said strip as the strip travels along the input conveyor.

4. A method as claimed in claim 1, wherein the front portion of each said strip is removed pneumatically from the input conveyor at the loading station.

5. A method as claimed in claim 1, wherein each said group is fed precessionally by the rolling device along said path.

6. A method as claimed in claim 1, wherein said path is substantially circular.

7. A method of producing filter-tipped cigarettes, the method comprising stages of successively feeding respective transfer conveyors with groups, each comprising two cigarette portions, a double filter between the two cigarette portions, and a gummed strip connected integral with, along a generating line of, and projecting from, said group; winding each strip about the respective group by feeding the group along a respective rolling channel by means of the respective transfer conveyor moving at a first speed; and feeding each rolling channel along a given path and at a second speed to an unloading station; each transfer conveyor presenting a seat for a respective said group; and each group being transferred into the respective said seat off an input conveyor substantially tangent to said path at a loading station; each said gummed strip, when on the input conveyor, being so positioned on the respective group as to project frontwards from the group in the traveling direction of the input conveyor; said second speed being a substantially constant speed, and said first speed being a variable speed.

8. A method as claimed in claim 7, wherein said first speed differs from said second speed.

9. A method as claimed in claim 8, wherein said first speed presents a first value at said loading station and a second value at said unloading station; the second value being greater than the first.

10. A method as claimed in claim 7, wherein said first speed assumes different values at said loading and unloading stations.

11. A method as claimed in claim 7, including a further stage of retaining by suction the front portion of each said strip as the strip travels along the input conveyor.

12. A method as claimed in claim 7, wherein the front portion of each said strip is removed pneumatically from the input conveyor at the loading station.

13. A method as claimed in claim 3, wherein each said group is fed precessionally by the rolling device along said path.

14. A method as claimed in claim 3, wherein said path is substantially circular.

* * * * *